US005823892A

United States Patent [19]

Kuo

[11] Patent Number: 5,823,892

[45] Date of Patent: Oct. 20, 1998

[54] MALLET FOR CROQUET

[76] Inventor: Wen-Hai Kuo, No. 536, Sec. 2, Ho-Sheng Rd., Ping-Tung City, Taiwan

[21] Appl. No.: 886,941

[22] Filed: Jul. 2, 1997

[51] Int. Cl.[6] ..... A63B 59/10

[52] U.S. Cl. ..... 473/412; 473/296; 473/295

[58] Field of Search ..... 473/410, 412, 473/558, 293, 288, 296, 295

[56] References Cited

U.S. PATENT DOCUMENTS

| | | | |
|---|---|---|---|
| 2,755,833 | 7/1956 | Quayle | 473/296 |
| 2,832,598 | 4/1958 | Strub | 473/296 |
| 3,284,114 | 11/1966 | McCord, Jr. et al. | 473/296 |
| 3,524,646 | 8/1970 | Wheeler | 473/288 |
| 3,663,019 | 5/1972 | Palotsee | 473/296 |
| 4,881,737 | 11/1989 | Mullins | 473/558 |
| 5,282,619 | 2/1994 | Napolitano et al. | 473/296 |

*Primary Examiner*—Mark S. Graham
*Attorney, Agent, or Firm*—Varndell Legal Group

[57] ABSTRACT

A mallet for croquet, including a tubular main shaft, a tubular auxiliary shaft slidably mounted in the main shaft and fixed at the desired location by a binding ring and a chuck sleeve, an extension rod slidably mounted in the auxiliary shaft and secured in the extended position by a split ring, a head for hitting the ball, and a swivel connector having a rear end plugged into one end of extension rod remote from the auxiliary shaft and an opposite end terminating in a ball knob secured in a circularly recessed face of a ball seat in a hole in the middle of the head by a socket.

2 Claims, 8 Drawing Sheets

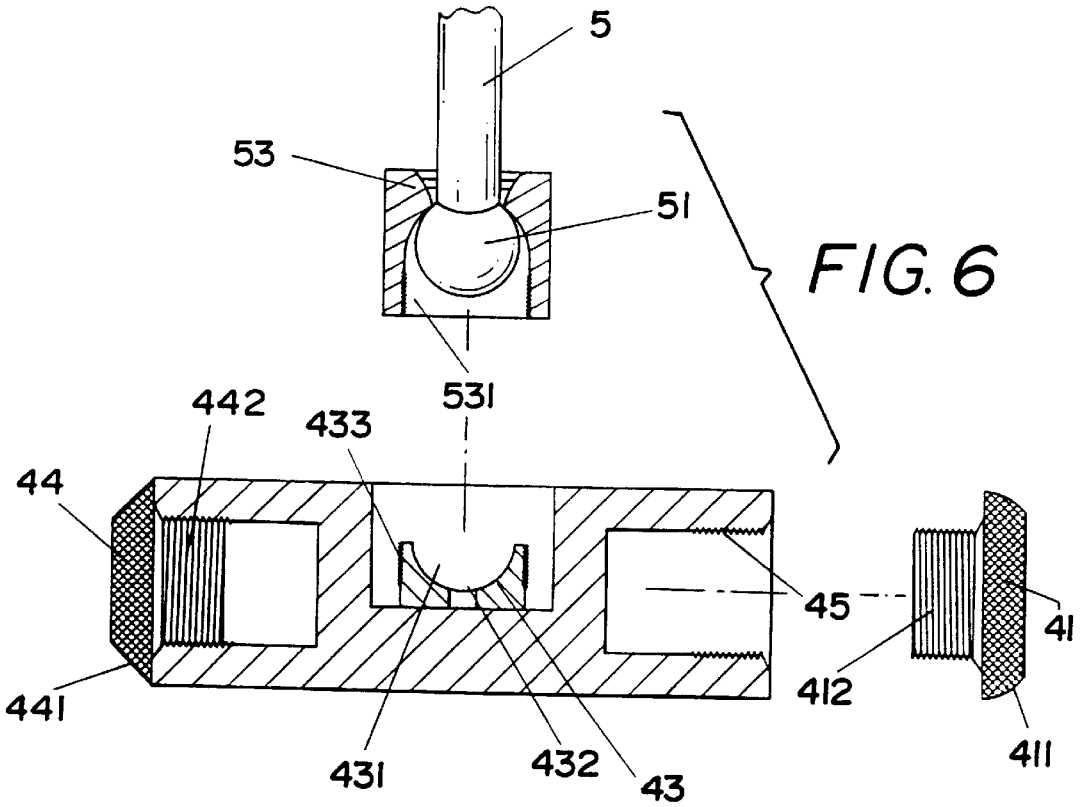
FIG. 6
FIG. 7
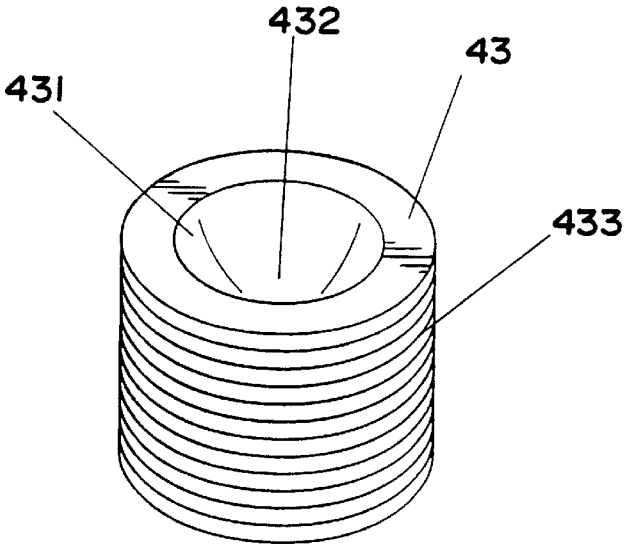

MALLET FOR CROQUET

BACKGROUND OF THE INVENTION

The present invention relates to a mallet for croquet, and more particularly to such a mallet in which the shaft can be conveniently adjusted to the desired length, and the head can be adjusted to the desired angle.

A conventional mallet for croquet is generally comprised of a shaft (handle), and a cylindrical head fixedly fastened to one end of the shaft. This structure of mallet has drawbacks. Because the shaft is a solid member, its length is not adjustable. Therefore, a mallet cannot fit all people. Further, because the head is fixedly fastened to the shaft, the angular position of the head is not adjustable.

SUMMARY OF THE INVENTION

The present invention has been accomplished to provide a mallet for croquet which eliminates the aforesaid drawbacks. According to one embodiment of the present inventions the mallet comprises a tubular main shaft, a tubular auxiliary shaft slidably mounted in the main shaft and fixed at the desired location bid a binding ring and a chuck sleeve, an extension rod slidably mounted in the auxiliary shaft and secured in the extended position by a split ring, a head for hitting the ball, and a swivel connector having a rear end plugged into one end of extension rod remote from the auxiliary shaft and an opposite end terminating in a ball knob secured in a circularly recessed face of a ball seat in a hole in the middle of the head by a socket. In an alternate form of the present invention, the extension rod is eliminated, the auxiliary shaft is directly connected to the head by the swivel connector, and the main shaft is connected to the auxiliary shaft by a joint which permits the angular position of the main shaft to be conveniently adjusted relative to the auxiliary shaft.

BRIEF DESCRIPTION OF THE DRAWINGS

FIG. 6 is a sectional view along line 6—6 of FIG. 2, showing the internal structure of the head and the swivel connector;

FIG. 7 is an elevational view in an enlarged scale of the ball seat shown in FIG. 6;

DETAILED DESCRIPTION OF THE PREFERRED EMBODIMENTS

Figure 1:
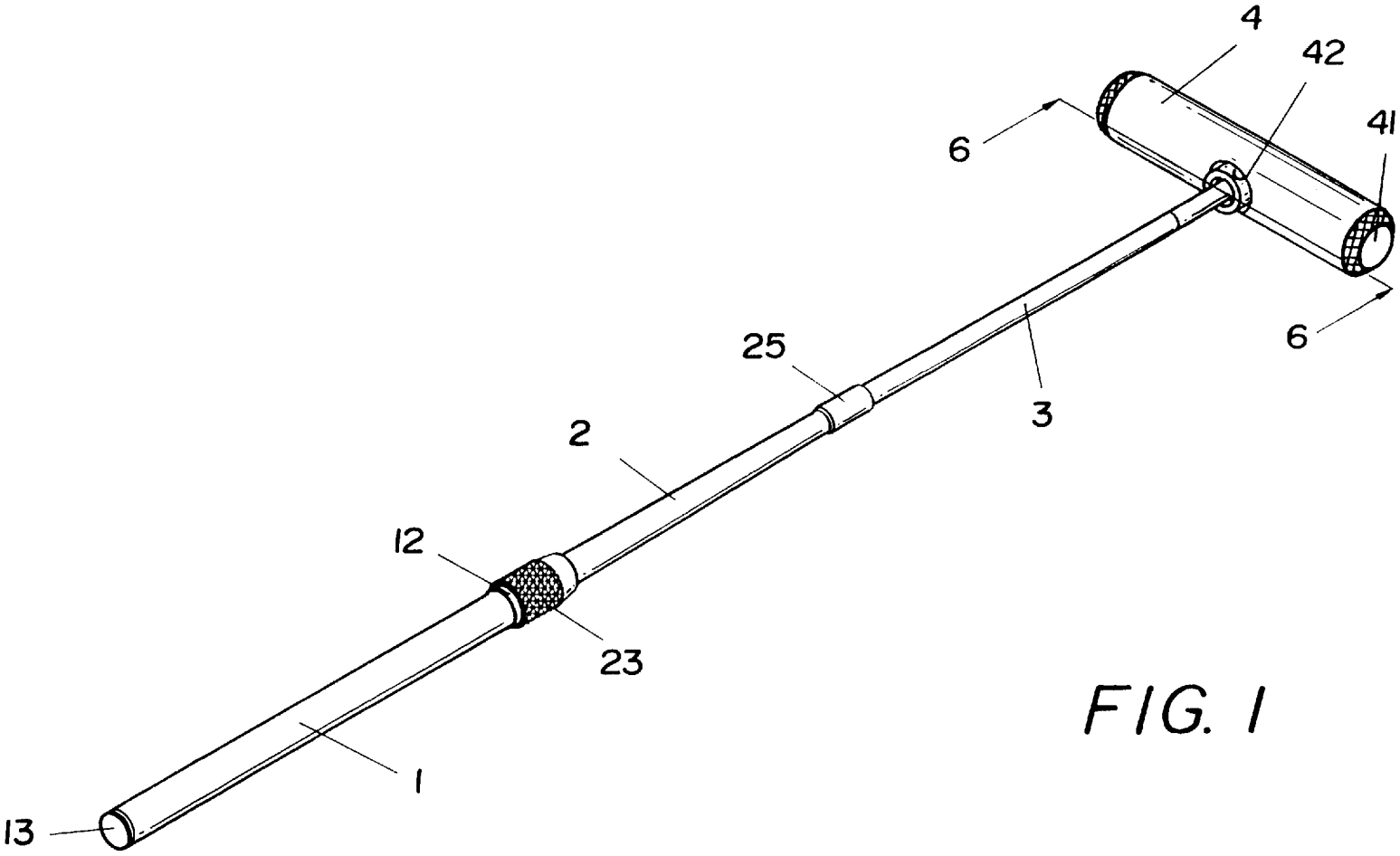
FIG. 1 is an elevational view of a mallet according to a first embodiment of the present invention.
Figure 2:
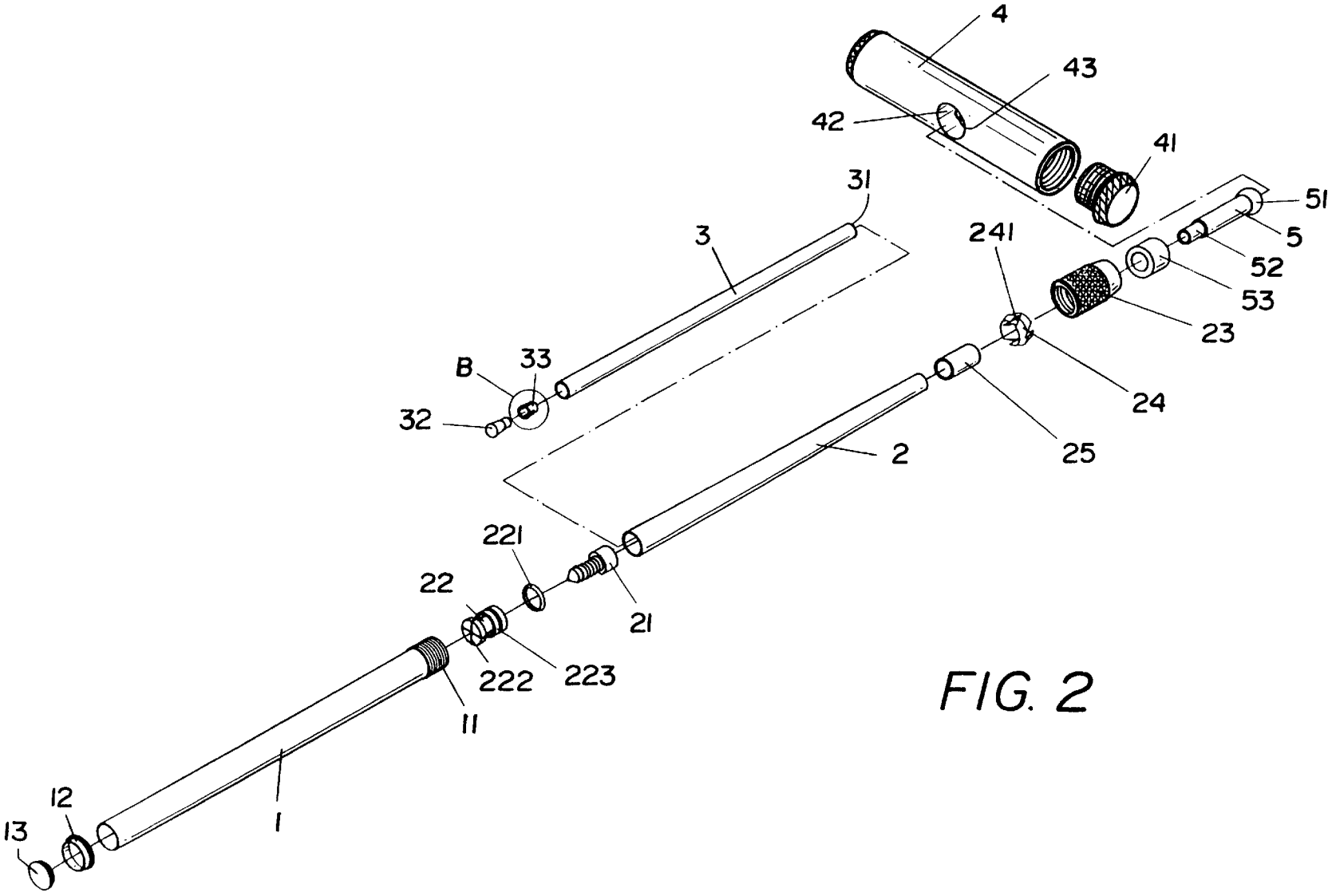
FIG. 2 is an exploded view of the mallet shown in FIG. 1.

Referring to FIGS. 1 and 2, a mallet in accordance with the present invention is generalize comprised of a main shaft 1, an auxiliary shaft 2, an extension rod 3, a head 4, and a swivel connector 5.

Referring to FIGS. 1 and 2 again, the main shaft 1 is a hollow round rod having an outer thread 11 at its front end. The rear end of the main shaft I is mounted with a screw ring 12 and sealed by an end cap 13.

Figure 3:
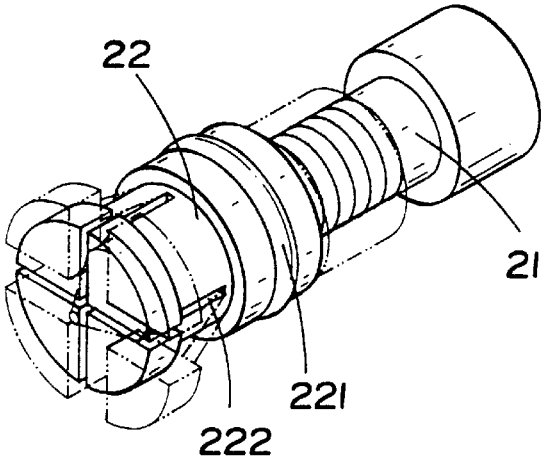
FIG. 3 is a perspective view of a part of the mallet shown in FIG. 1, showing the screw member threaded into the expansion member.
Figure 4:
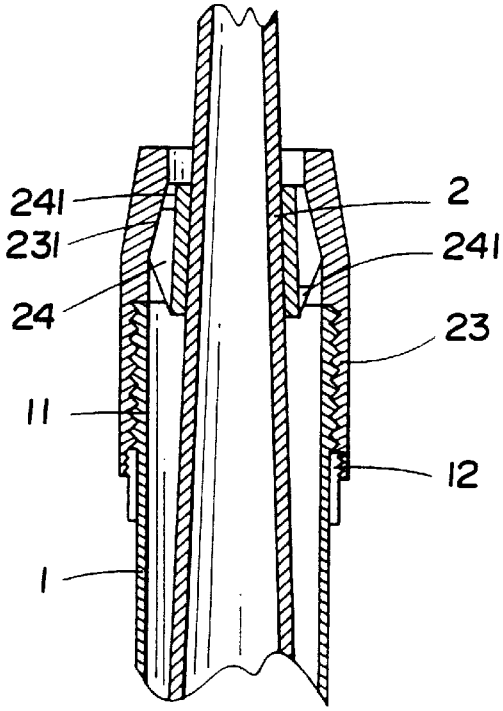
FIG. 4 is a sectional view of a part of the mallet shown in FIG. 1, showing the chuck sleeve threaded onto the outer thread of the main shaft, the binding ring compressed.

Referring to FIGS. 3 and 4 and FIG. 1 and 2 again, the auxiliary shaft 2 is a hollow round rod having a diameter gradually reducing from its rear end toward its front end and adapted for receiving the extension rod 3. A screw member 21 is fixedly fastened to the rear end of the auxiliary shaft 2. An internally threaded expansion member 22 is provided having an annular groove 223 at one end onto which a rigid ring 221 is mounted, and a split head 222 at an opposite end. When the screw member 21 is threaded into the expansion member 22, the split head 222 is expanded and firmly secured to the inside wall of the front end of the main shaft 1, and therefore the main shaft 1 and the auxiliary shaft 2 are connected together. A binding ring 24 is sleeved onto the auxiliary shaft 2, having a plurality of longitudinal splits 241. A chuck sleeve 23 is sleeved onto the auxiliary shaft 2 and then threaded onto the outer thread 11 of the main shaft 1 to hold down the binding ring 24, causing it to be firmly secured to the outside wall of the auxiliary shaft 2. Further, the front end of the auxiliary shaft 2 is mounted with a locating cap 25.

Figure 2A:
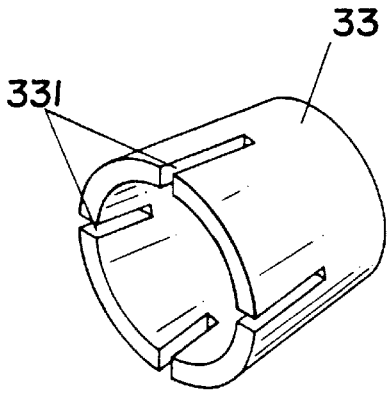
FIG. 2A is an enlarged view of part B of FIG. 2, showing the structure of the conical split ring.
Figure 5:
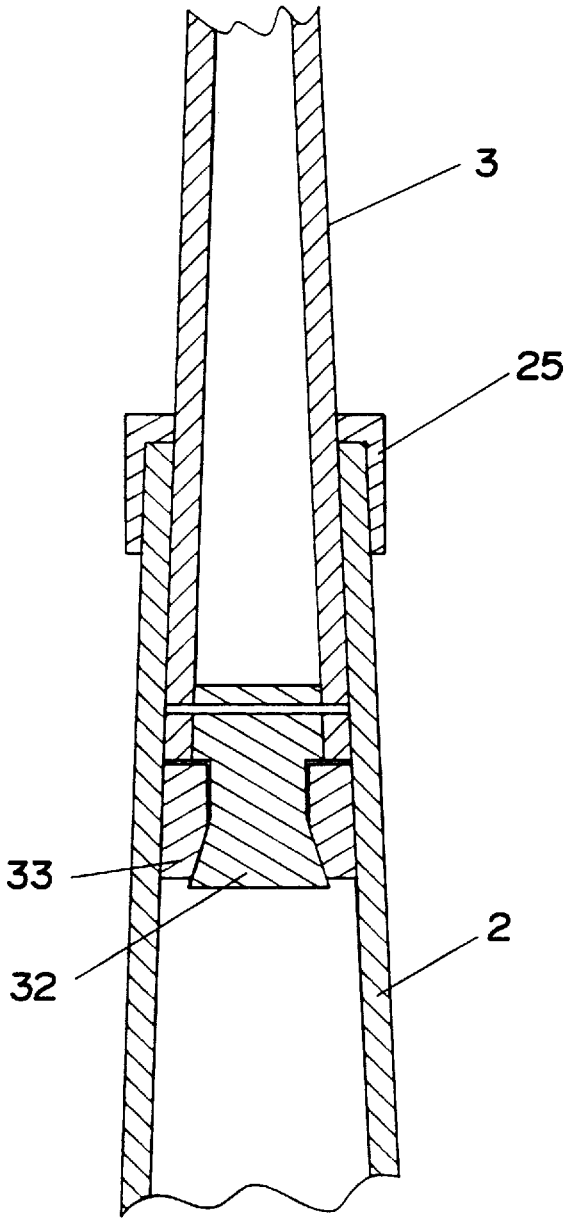
FIG. 5 is a sectional view of a part of the mallet shown in FIG. 1, showing the extension rod secured to the auxiliary shaft in the extended position.

Referring to FIGS. 2A and 5 and FIGS. 1 and 2 again, the extension rod 3 is a hollow round rod inserted through the auxiliary shaft 2, having a plug hole 31 at its front end, a locating block 32 at its rear end, and a conical split ring 33 on the locating block 32. The conical split ring 33 has a plurality of longitudinal splits 331.

Referring to FIGS. 6 and 7 and FIGS. 1 and 2 again, the head 4 is a hollow cylindrical member made from aluminum and covered with a glass fiber covering, having two face members 41;44 at its two ends and a ball seat 43 in a radial blind hole 42 in the middle. The ball seat 43 has an inner end fixedly fastened to the bottom side of the radial blind hole 42, an outer end terminating in a circularly recessed face 431, an outer thread 433 around the periphery, and a center hole 432 at the center of tile circularly recessed face 431.

Referring to FIG. 6 and FIG. 1 and 2 again, the swivel connector 5 comprises a ball knob 51 at one end, and a plug pin 52 at an opposite end for connection to the plug hole 31 of the extension rod 3. Further, a socket 53 is sleeved onto the swivel connector 5 and fastened to the ball seat 43 to hold the ball knob 51 in the circularly recessed face 431. The socket 53 has an inner thread 531 adapted for threading onto the outer thread 433 of the ball seat 43 to hold the ball knob 51 in the circularly recessed face 431 of the ball seat 43.

Referring to FIG. 3 again, the rigid ring 221 is mounted on the annular groove 223 of the expansion member 22 to protect the front end of the expansion member 22 against expansion force upon its installation on the screw member 21. After the expansion member 22 has been threaded onto the screw member 21, it is moved with the auxiliary shaft 2 in the main shaft 1 to the desired position. Then, a pressure is given through the auxiliary shaft 2 to the expansion member 22 against the inside wall of the main shaft 1, and then the auxiliary shaft 2 is rotated to thread the screw member 21 into the expansion member 22 deeply, thereby causing the expansion member 22 to expand and to engage the inside wall of the main shaft 1.

Referring to FIG. 4 again, when the position of the auxiliary shaft 2 relative to the main shaft 1 is adjusted, the chuck sleeve 23 is tightly threaded onto the outer thread 11 to hold down the binding ring 24 against the periphery of the rear end of the auxiliary shaft 2, and therefore the connection between the main shaft 1 and the auxiliary shaft 2 is locked.

Referring to FIG. 5 again, when the extension rod 3 is extended out of the front end of the auxiliary shaft 2, the split ring 33 is forced by the locating block 32 to expand and to engage the inside wall of the auxiliary shaft 2, and therefore the extension rod 3 is firmly retained to the auxiliary, shaft 2 at the extended position.

Referring to FIGS. 6 and 7 again, the head 4 further comprises two inner threads 45 respectively disposed at its both ends. The face members 41;44 have a respective screw rod 412;442 respectively threaded into the inner threads 45 of the head 4, and a respective peripherally embossed truncated cone 411;441 for hitting the ball. When the connector 5 is connected between the extension rod 3 and the head 4, the angular position of the head 4 relative to the ball knob 51 of the head 4 can be freely adjusted.

Figure 8:
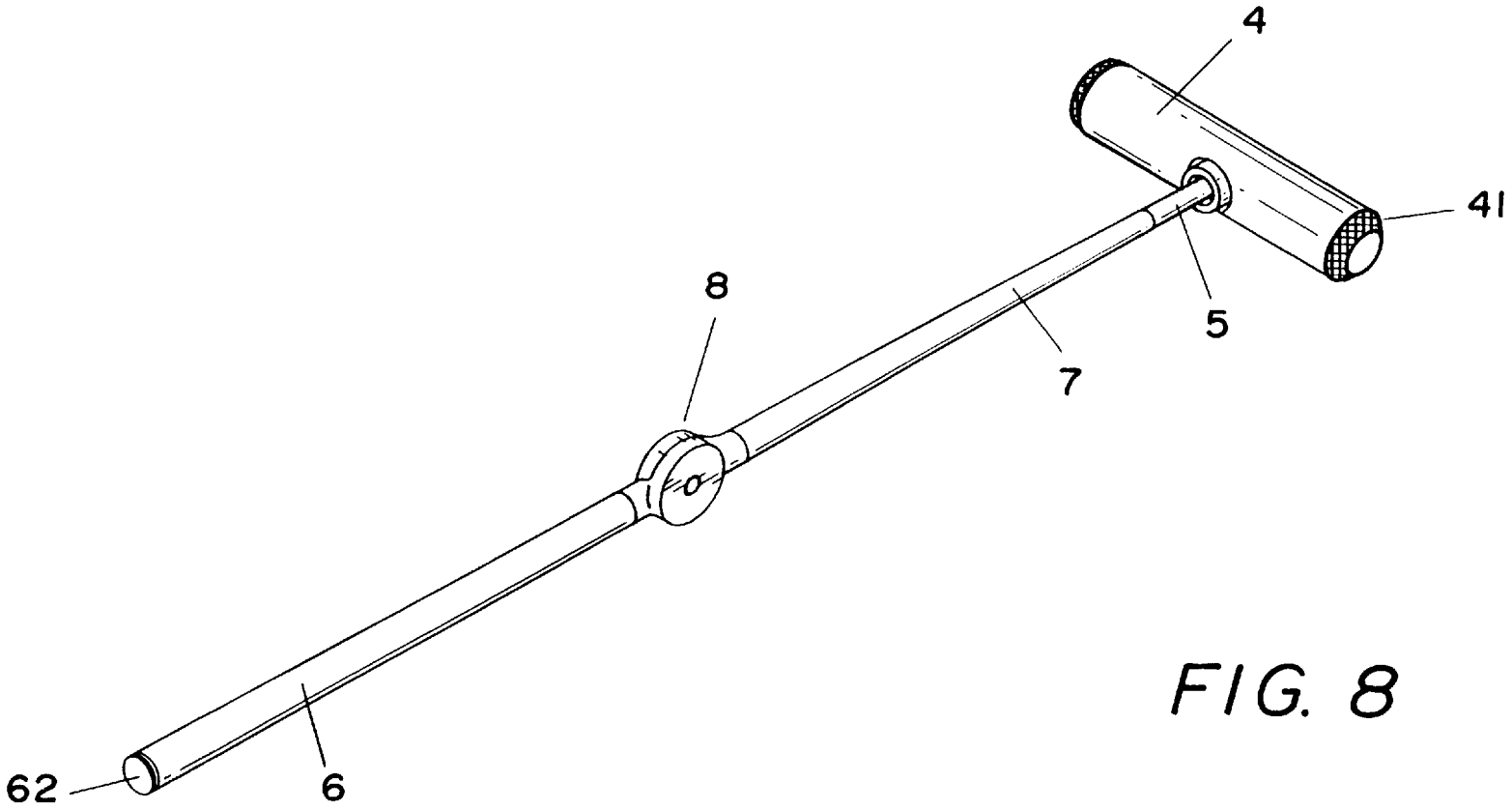
FIG. 8 is an elevational view of a mallet according to a second embodiment of the present invention.
Figure 9:
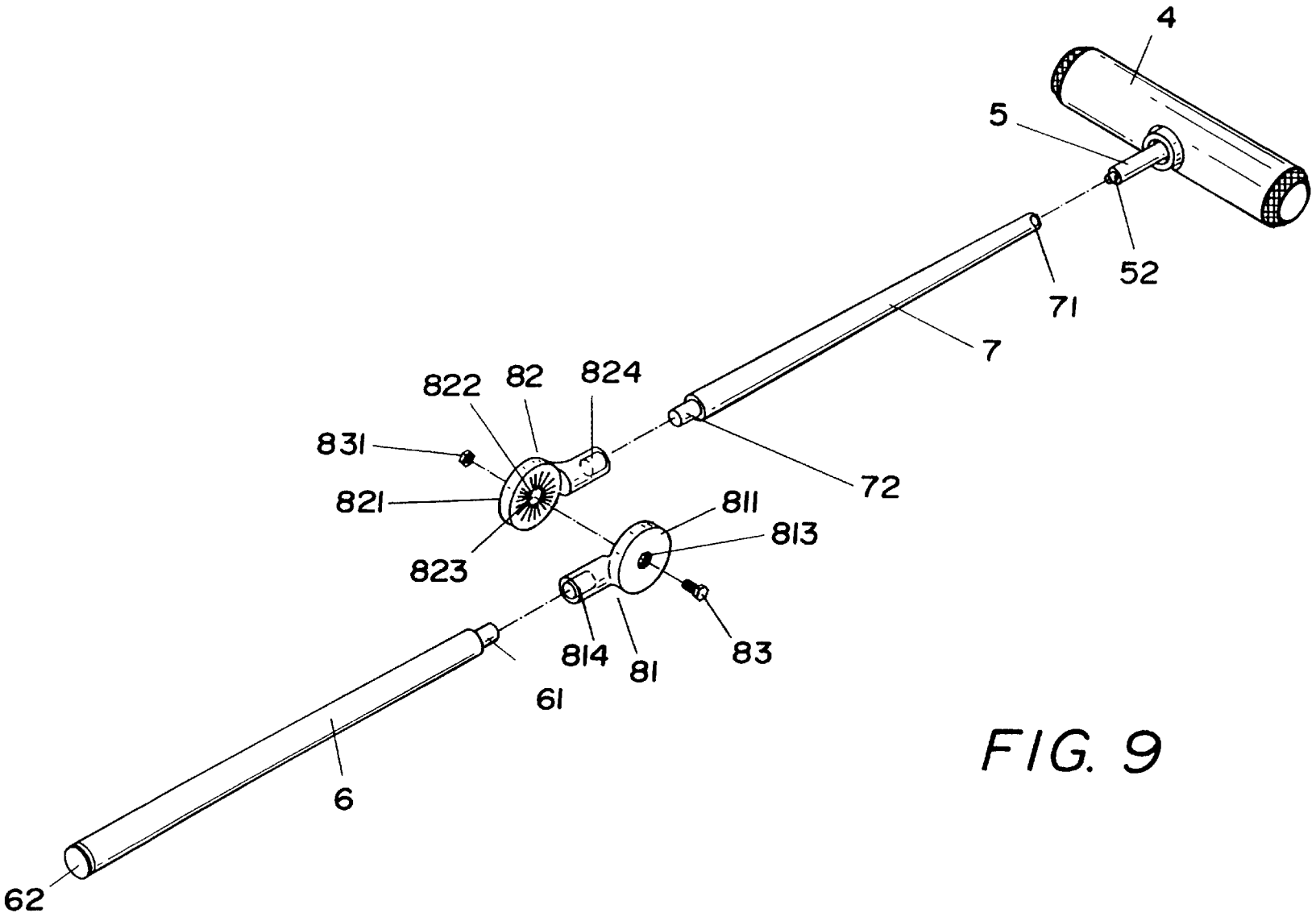
FIG. 9 is an exploded view of the mallet shown in FIG. 8.
Figure 10B:
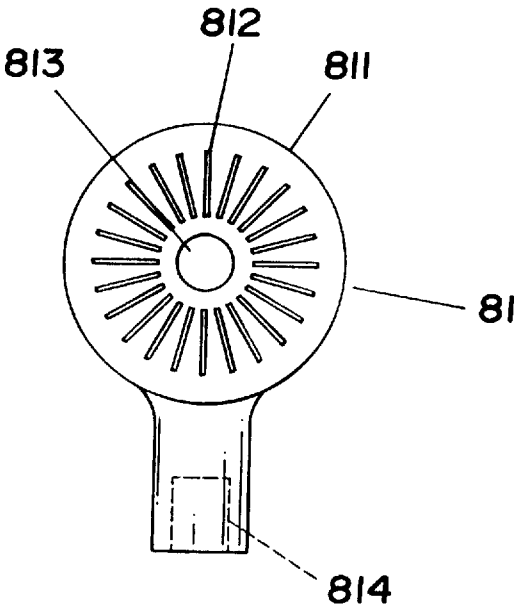
FIGS. 10A and 10B are plain views of the connecting blocks of the joins shown in FIG. 9.
Figure 10A:
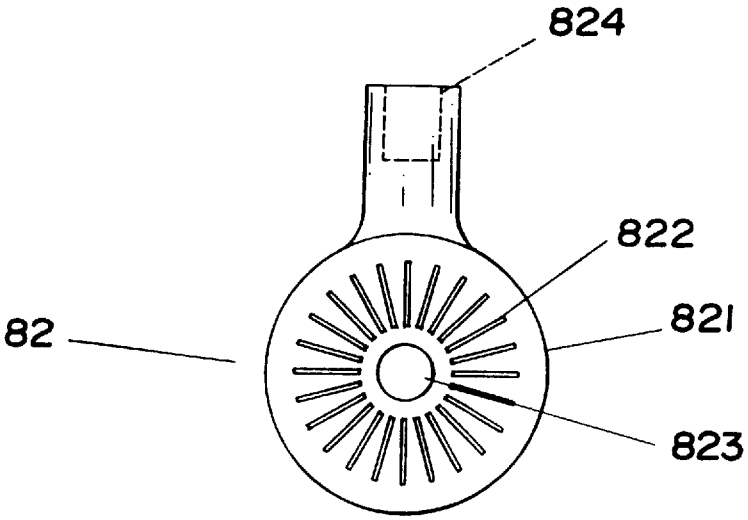

FIGS. 8, 9 and 10 show an alternate form of the present invention This mallet is comprised of a main shaft 6, an auxiliary shaft 7, a head 4, a swivel connector 5, and a joint 8. The main shaft 6 is a hollow, aluminum round rod covered with a glass fiber covering, having a plug pin 61 at its front end and a seal cap 62 at its rear end. The auxiliary shaft 7 has a plug hole 71 at its front end, and a plug pin 72 at its rear end. The head 4 and the swivel connector 5 are identical to the aforesaid first embodiment of the present invention. The joint 8 is comprised of two symmetrical connecting blocks 81;82. The connecting block 81;82 comprises a circular base 811;821, radial teeth 812;822 at an inner side of the circular base 811;821, a screw hole 813;823 at the center of the circular base 811;821 and a coupling tube 814;824 extended from the periphery of the circular base 811;821. When the plug pin 61 of the main shaft 6 and the plug pin 72 of the auxiliary shaft 7 are respectively plugged into the coupling tubes 814;824 of the connecting blocks 81;82., a screw 83 is threaded into the screw holes 813;823 of the connecting blocks 81;82 and screwed up with a nut 831, causing the radial teeth 812;822 of the connecting blocks 81 to be meshed together. By loosening the nut 831, the connecting blocks 81;82 can be disengaged from each other and turned relative to each other to adjust the angular position of the auxiliary shaft 7 relative to the main shaft 6.

It is to be understood that the drawings are designed for purposes of illustration only, and are not intended as a definition of the limits and scope of the invention disclosed.

I claim:

1. A mallet for croquet, comprising:

a main shaft made from a hollow round rod having an outer thread at a front end thereof and a rear end sealed by an end cap;

an auxiliary shaft made from a hollow round rod and inserted into the front end of said main shaft and secured at a desired location, said auxiliary shaft comprising a screw member at a rear end thereof, an internally threaded expansion member threaded onto said screw member and forced to expand and to engage an inside wall of said main shaft, and a locating cap at a front end thereof, said expansion member comprising an annular groove at one end around its periphery, a rigid ring mounted on said annular groove and a split head at an opposite end, lock means fastened to said main shaft to secure said auxiliary shaft in position, said lock means comprising a binding ring sleeved onto said auxiliary shaft and having a plurality of longitudinal splits, and a chuck sleeve sleeved onto said auxiliary shaft and threaded onto the outer thread of said main shaft to hold down said binding ring against the periphery of the rear end of said auxiliary shaft;

an extension rod made from a hollow round rod inserted through said auxiliary shaft and extended out of the locating cap of said auxiliary shaft, said extension rod having a plug hole at a front end thereof, a locating block at a rear end thereof, and a conical split ring on said locating block, said conical split ring being forced to expand and to engage an inside wall of said auxiliary shaft when said extension rod is extended out of said auxiliary shaft, causing said extension rod to be firmly secured to said auxiliary shaft at an extended position;

a hollow cylindrical head made from aluminum and covered with a glass fiber covering, having two face members at two opposite ends thereof, a radial blind hole in the middle, and a ball seat mounted inside said radial blind hole, said ball seat having a circularly recessed face at an outer end thereof, an outer thread around its periphery, and a center hole at the center of said circularly recessed face; and a swivel connector comprising a ball knob at one end received in the circularly recessed face, a plug pin at an opposite end plugged into the plug hole of said extension rod, and a socket having an inner thread threaded onto the outer thread of said ball seat, said socket forming with said ball seat a ball socket which receives said ball knob, for permitting said ball knob to be turned in said circularly recessed face to adjust the angular position of said extension rod relative to said head.

2. A mallet for croquet, comprising:

a main shaft made from a hollow, aluminum round rod covered with a glass fiber covering, having a plug pin at a front end thereof and a seal cap at a rear end thereof;

an auxiliary shaft having a plug hole at a front end thereof, and a plug pin at a rear end thereof;

a joint adapted to connect said main shaft and said auxiliary shaft together, said joint comprising a first connecting block, a second connecting block, a screw and a nut, said first connecting block comprising a circular base, a plurality of radial teeth at an inner side of the circular base of said first connecting block, a screw hole at the center of the circular base of said first connecting block, and a coupling tube extended from the circular base of said first connecting block and connected to the plug pin of said main shaft, said second connecting block comprising a circular base, a plurality of radial teeth at an inner side of the circular base of said second connecting block for engagement with the radial teeth of the circular base of said first connecting block, a screw hole at the center of the circular base of said second connecting block, and a coupling tube extended from the circular base of said second connecting block and connected to the plug pin of said auxiliary shaft, said screw is threaded into the screw holes of said first connecting block and said second connecting block and screwed up with said nut to secure said first connecting block and said second connecting block together;

a hollow cylindrical head made from aluminum and covered with a glass fiber covering, having two face members at two opposite ends thereof, a radial blind hole in the middle, and a ball seat mounted inside said radial blind hole, said ball seat having a circularly recessed face at an outer end thereof, an outer thread around its periphery, and a center hole at the center of said circularly recessed face; and a swivel connector comprising a ball knob at one end received in the circularly recessed face of said ball seat, a plug pin at an opposite end plugged into the plug hole of said auxiliary shaft, and a socket having an inner thread threaded onto the outer thread of said ball seat to hold said ball knob in the circularly recessed face of said ball seat.

* * * * *